US007584805B2

(12) United States Patent
Skaggs

(10) Patent No.: US 7,584,805 B2
(45) Date of Patent: Sep. 8, 2009

(54) BOX SCRAPER

(76) Inventor: David W. Skaggs, 34875 POaintridge Rd., Woodland, CA (US) 95695

( * ) Notice: Subject to any disclaimer, the term of this patent is extended or adjusted under 35 U.S.C. 154(b) by 4 days.

(21) Appl. No.: 11/903,398

(22) Filed: Sep. 24, 2007

(65) Prior Publication Data

US 2009/0078436 A1 Mar. 26, 2009

(51) Int. Cl.
*A01B 31/00* (2006.01)

(52) U.S. Cl. ..... 172/684.5; 172/445.2

(58) Field of Classification Search ..... 172/684.5, 172/799.5, 781, 788, 792, 795, 796, 811, 172/815, 817–820, 753, 683; 37/268, 280, 37/281, 105, 267, 444, 445
See application file for complete search history.

(56) References Cited

U.S. PATENT DOCUMENTS 213,913 A * 4/1879 Luce ..... 16/362
593,969 A * 11/1897 Patton ..... 37/445
2,393,432 A * 1/1946 Turner ..... 37/444
2,839,851 A * 6/1958 Geiszler ..... 172/197
3,058,243 A * 10/1962 McGee ..... 172/197
4,044,843 A * 8/1977 Holub ..... 172/825
4,535,847 A * 8/1985 Hasegawa et al. ..... 172/2
4,869,326 A * 9/1989 Hutchins et al. ..... 172/197
5,332,331 A * 7/1994 Critz et al. ..... 404/96
5,758,728 A * 6/1998 Ragule ..... 172/815

* cited by examiner

*Primary Examiner*—Robert E Pezzuto
*Assistant Examiner*—Matthew D Troutman
(74) *Attorney, Agent, or Firm*—William S. Bernheim

(57) ABSTRACT

A box scraper for use with a pulling or a pushing vehicle, having a continuous box-form main frame above, with a lower portion of the rear wall, the moldboard, hinged to the side wall at one end and held to the opposite side wall by a lock mechanism such that one end of the moldboard can be released backwards from that sidewall; when thus released allowing for a smooth and continuous lateral release of scraped materials outside the confines of the scraper box.

5 Claims, 6 Drawing Sheets

BOX SCRAPER

BACKGROUND OF THE INVENTION

1. Field of Invention

This invention relates to a tractor mountable box scraper capable of measured and level release of material from the scraper by use of a controlled back plate (moldboard) which is hinged at its junction with one of the side plates and controllably separates from the opposite end side plate.

2. Relevant Prior Art

For years, simple box scrapers have been used to scrape up and drag materials such as soil, road building and like materials from one location to another. The most common uses being to level or create specific grades of soil level, fill in unwanted holes, or simply to remove excess materials.

A box scraper can be described as three sides of a box with neither top nor bottom nor a complete top to bottom front side wall. The back plate (moldboard) of the box is welded to a left side-plate and to a right side-plate, both of which extend forward from their respective side edges of the moldboard. The moldboard can be formed from a single sheet of metal, or comprise two or more plates welded together to form a wall which when viewed from the side has its lower edge situated slightly forward of the upper part of the wall; this being accomplished by a forward tilt of the base of the entire moldboard, or curvature of a portion or all of the back wall, or the angulation forward at the base of the lowest unit of a sectionally formed moldboard.

For greater cutting efficiency, the inferior portion of the moldboard can be formed of a removable section made from a more durable material suitable for use as, and sharpened to act as a cutting blade. The three sided box provides a containment vessel within which the scraped up material can pile up and does pile up as the back side is pulled forward and cuts into the underlying surface material.

The scraped up material is kept from moving side ways and around the ends of the blade by the side plates, necessitating that the whole box assembly be raised vertically in order to drop, or to spread the contained material over a new area at the width of the back blade. Alternatively, the box scraper can be tilted to raise or lower the left side relative to the right side and vice versa. In this tilted manner, piled material can escape but control is difficult, release is not in a level manner and it is easy to gouge the surface of the ground in an undesirable manner with whichever side of the scraper is lower. Elevation of the blade is accomplished by activating a hydraulic ram that is attached to the towing tractor; tilting, is accomplished by controls that are part of the three point hitch assembly of the tractor itself.

A problem arises when it is desired to drop or spread the piled up material to the side of the scraper box because it necessitates multiple and often complex maneuvering of the tractor to do this. Also, to date, box scrapers have not been suitable for berming scraped up material either on the right or on the left on an optional basis. These problems have limited the use of an otherwise versatile tool.

SUMMARY OF THE INVENTION

Objects of the Invention

It is an object to provide a box scraper which optionally does not need to be lifted or tilted to release the material being moved because one end of the mold board section is attached to its respective side wall by a hinge, with the opposite end being held approximating its side wall by a lock, thus allowing of creating an opening through which the scraped material can escape between the mold board and one side of the box scraper's side walls A further object of this invention is to provide a box scraper which can optionally side-shift material, which has been or is being scraped, and deposit that material into a berm or windrow situated to the side of the tractor and scraper, thus allowing the box scraper of the current invention to fully perform tasks that would otherwise require bringing in a separate piece of equipment such as a grader as a secondary effector.

A further object is to provide a box scraper which can optionally back-fill swales, ditches, furrows, trenches and other such excavations while making a single pass along the bermed material priorly excavated.

A further object is to expand the uses possible with a box scraper such that other equipment need not be used as secondary effectors in order to accomplish tasks such as cutting firebreaks in grassy areas, which formerly required the use of a grader, or a tractor pulling a set of discs to turn the grass under.

A further object is to provide a box scraper that can optionally be used as a bulldozer capable of angle blade operation in varying degrees when the tractor unit is moving in reverse.

A yet further object is to ensure that excess force is not exerted on the hinge, this being accomplished by a reinforcement-system that provides vertical support against sag of the moldboard and prevents warping of the scraper's main frame by providing sufficient strength to resist the force imposed on the main frame as the moldboard is dragged forward or pushed backward.

These and other objects and advantages will be apparent to those skilled in the art in light of the following disclosure, claims and accompanying drawings.

BRIEF DESCRIPTION OF THE DRAWINGS

FIG. 5 shows the assembly as it appears with the lower portion of the moldboard in the closed position.

FIG. 6 shows the assembly as it appears with the lower portion of the moldboard in the open position.

DESCRIPTION OF A PREFERRED EMBODIMENT

Figure 1:
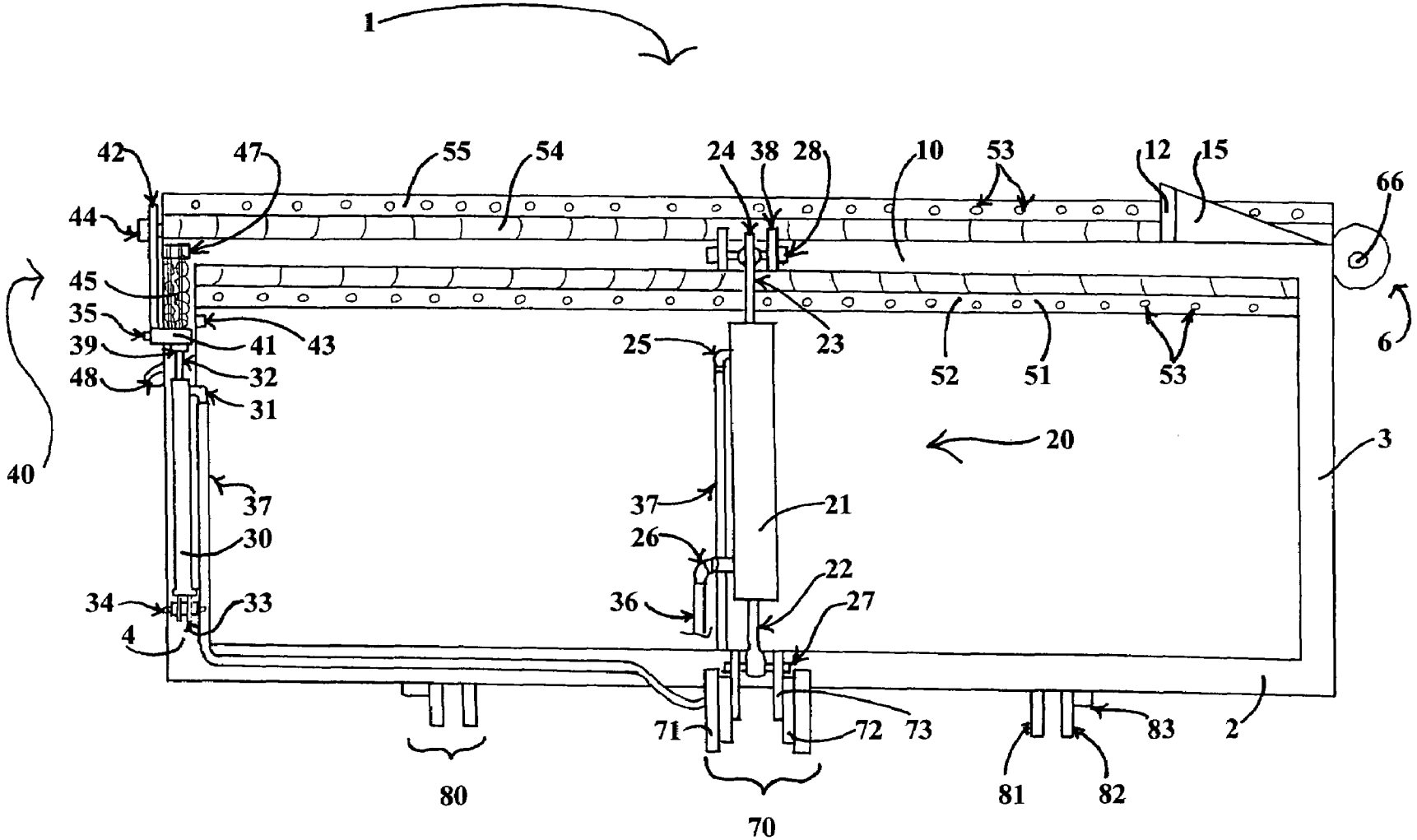
FIG. 1 Presents a top view of a box scraper in accordance with the invention and not to scale.

Note: in the following text, if there is no designation of a specific figure number when a part is first introduced along with its assigned reference character, it means that the reference character first appears in FIG. 1. Later references to the character number of that part will not be designated by the figure number unless for special emphasis. Character references not found on FIG. 1 will have the Figure number designated at their first appearance, after which the figure for these characters will be indicated by a number located within brackets ( )s or preceded by the abbreviation Figure when special emphasis is needed.

Figure 3:
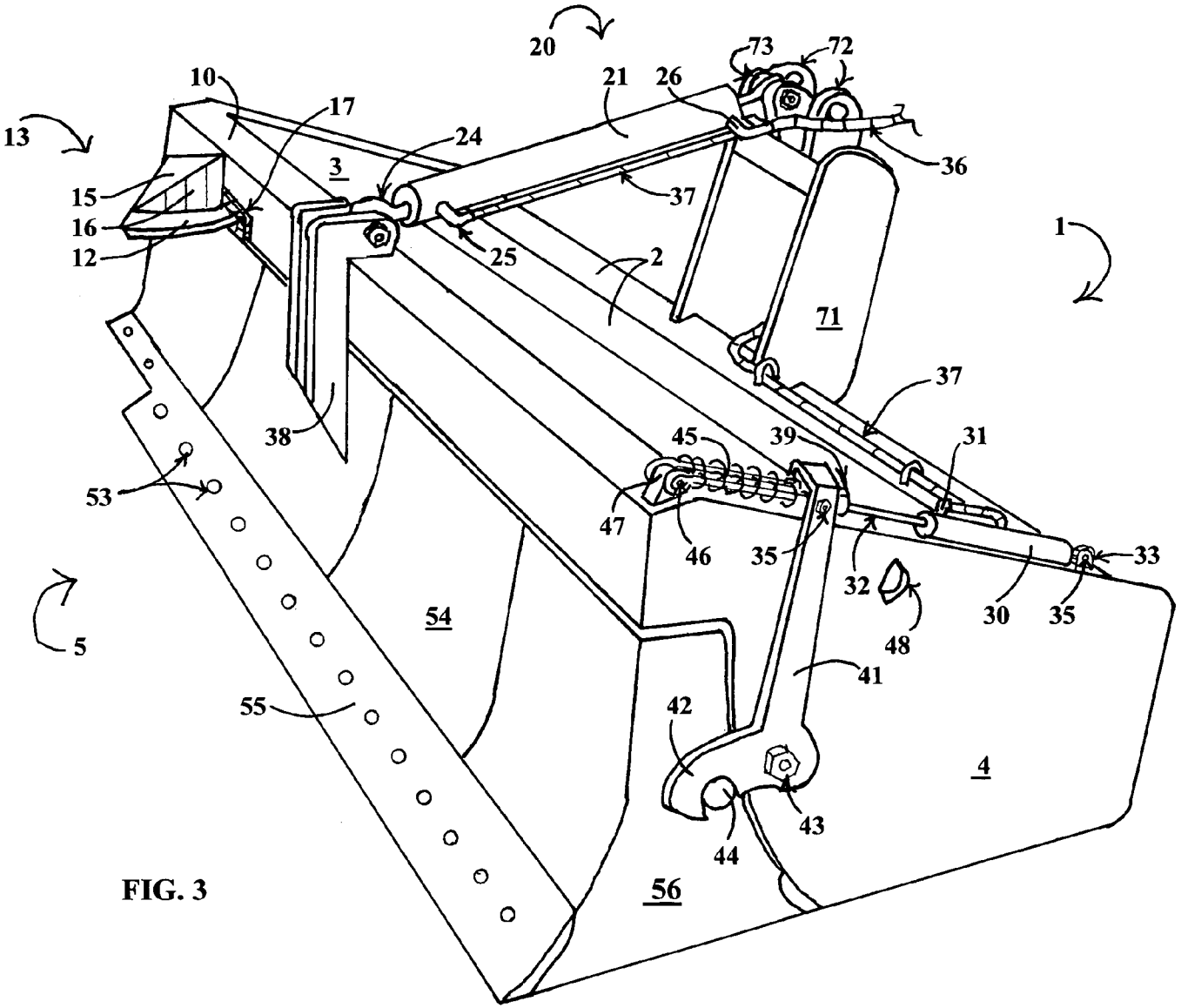
FIG. 3 Presents a perspective view of the rear of the scraper assembly looking across and slightly down onto the scraper assembly in accordance with the invention, and not to scale. This view would be seen from the opposite side of the tow vehicle to that presented in FIG. 2.
Figure 4:
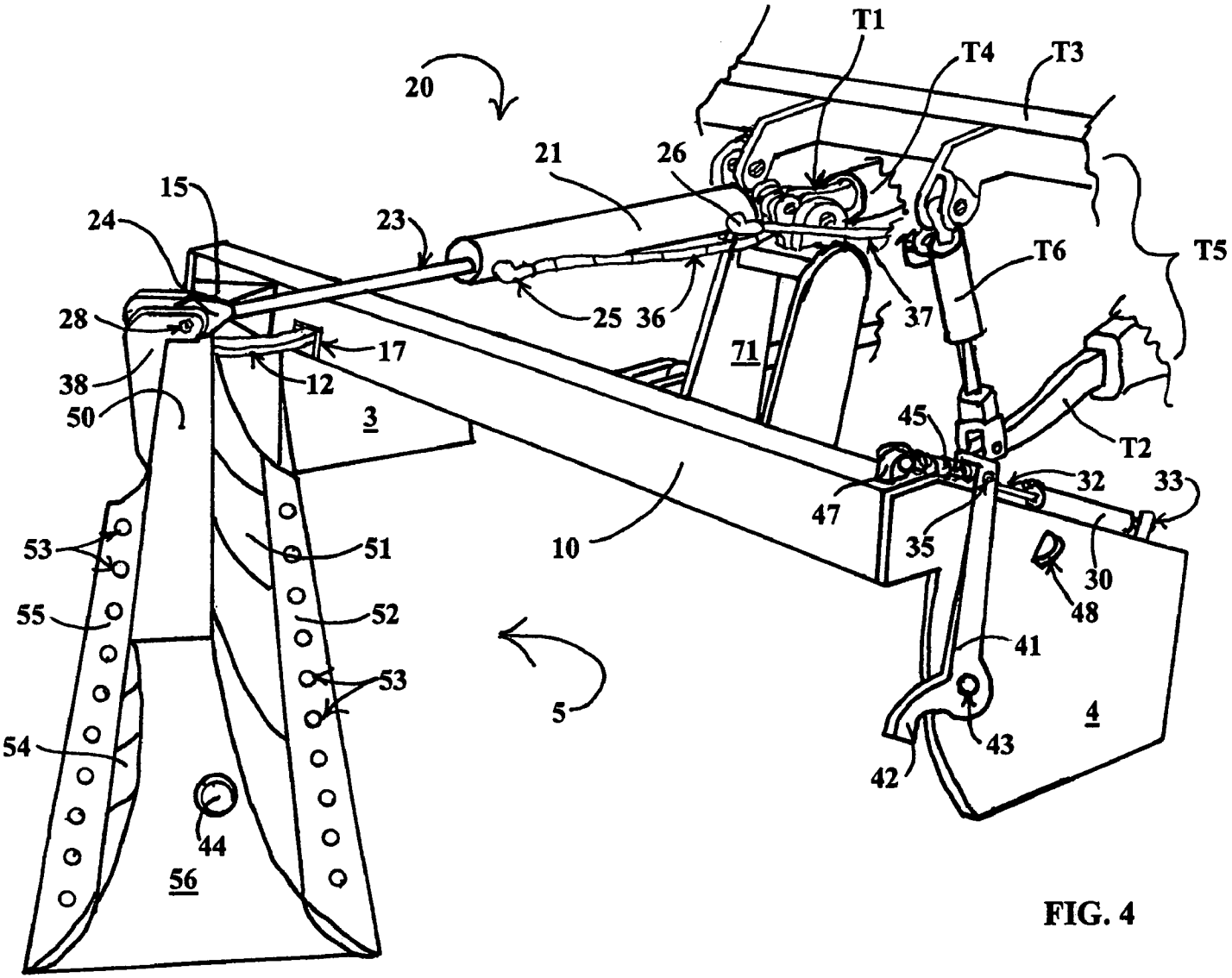
FIG. 4 Presents a perspective view of the rear of the scraper assembly with the moldboard section of the scraper hinged open to one side in accordance with the invention, and not to scale. The perspective angle is one of looking across and slightly down onto the scraper assembly. This view would be seen from the same side of the tow vehicle as the view presented in FIG. 3.
Figure 7:
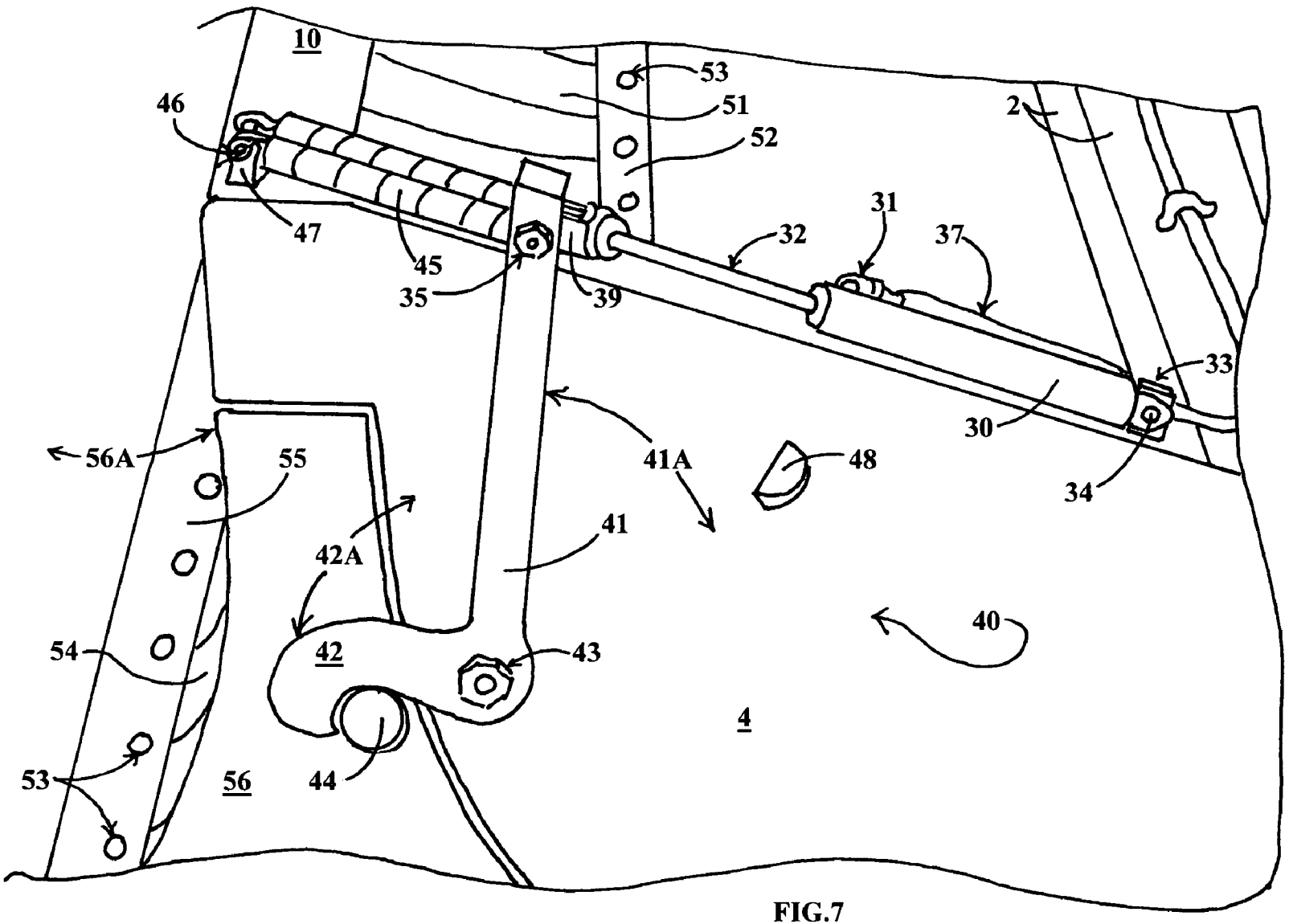
FIG. 7 Presents a detail view of the components of the lock assembly that allows of the use of the scraper as a conventional box scraper when locked; and allows the lower section of the Moldboard to swing back from the basic box when the lock assembly is released.

The invention involves the creation of a box-scraper (SA) 1, in which the typical construction of a box scraper is altered such that the rear-wall section known as a moldboard section (MBA), designated as 5 when referred to in its entirety and best seen in FIG. 4, is attached to a side wall 3 or 4 by a hinge assembly (hinge) 6 at one end and at its other extreme is attached to the opposite side wall 3 or 4 by a lock assembly (lock) designated 40 when referred to in its entirety and best seen in FIGS. 3&7. The SA 1 thus being constructed such that the MBA 5 can swing back in a controlled manner from it's contiguous side wall 3 or 4, thus allowing of direct deposition of scraped material to the side of the SA 1, which action was not possible with box scraper's prior to this invention. The SA 1 can be designed such that the hinge 6 is located either at the left or the right end of the MBA 5 with the opposite end enjoying the capability of being freed and swung back from its associated side wall 3 or 4 as described immediately prior.

As further description unfolds, it will become evident that special and adequate reinforcement has been made part of the design of the invention in order to afford the SA 1 with strength adequate to support the special strains added by the novel uses to which said SA 1 can be applied when said MBA 5, is used in the one end open position.

In the text that follows, the terms right and left are used to describe the side of the SA 1 that corresponds to a viewer's hands as they would be relative to the side plates 3,4 if the viewer was standing at the front of the SA 1 and looking back towards the rear of said SA.

Figure 2:
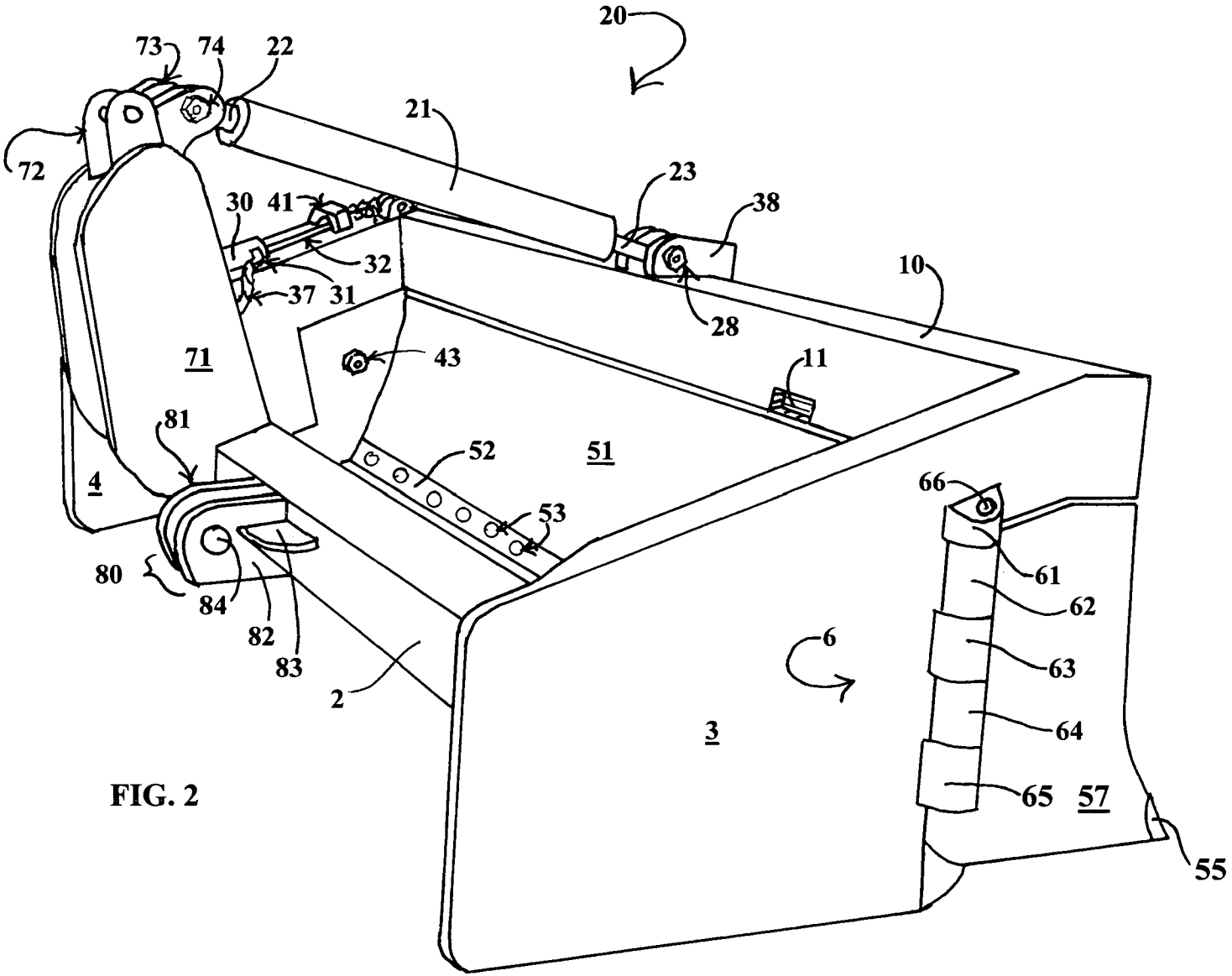
FIG. 2 Presents a prospective view looking across from the front and slightly from above the scraper assembly in accordance with the invention and not to scale. The position of viewing corresponds to a spot to the right rear of the tow vehicle when that vehicle is viewed looking from front to back.

The MBA 5 comprises five steel plates: four of which plates are best seen in FIG. 4 and include a top plate 50, a forward curved front plate 51, a backward curved rear plate 54, a left end plate 56; a right end plate 57, the latter being best seen in FIG. 2. The MBA 5 also has removable cutting edge elements (blades), a rear blade 55 and a front blade 52, said blades being affixed by a series of bolts 53 that screw into said curved front and back plates 51 and 54.

The right and left side plates 3, 4 of the SA 1 are conjoined at their forward top-corners by being welded to the opposite ends of a Front Top Beam (FTB) 2 which said FTB 2 spans across the otherwise open front end of said SA 1. A Rear Top Beam (RTB) 10 is best seen in FIG. 2, said RTB being welded to and thus conjoining side-plates 3,4 at their rear top-corners, crossing centrally above said MBA 5 as it does so.

All Figures referred to within this text show a configuration in which hinge 6 is on the right side of said SA 1 and the retractable end of said MBA 5 is on the left.

The component parts of hinge 6 are best viewed in FIG. 2 where it is seen that the hinge 6 is located at the junction of side plate 3 and MBA right end plate 57; said hinge being welded to the right side wall 3 by a series of steel tubular elements 61,63,65; and welded to the right end plate of the MBA 57 by steel tubular elements 62, and 64. A steel hinge Rod 66, only the top end of which can be seen, passes from top to bottom through hinge sections 61-65 thus uniting the right side wall 3 borne hinge sections to the right end plate of the MBA 57 borne elements of the hinge.

When the SA 1 is connected to a pulling vehicle, commonly a tractor (not shown); the connection is made via connection to the three point hitch array common to most tractors. FIG. 4 provides a view of the significant portions of the tractor borne three point hitch array, the components as a group being designated by a bracket T5. A left side hydraulic ram cylinder T6 depends from an upper support beam T3 and is attached inferiorly to a lower attachment arm T2 (the corresponding right side member are not shown). An extensible ram shaft T1 of a tractor controlled hydraulic ram unit T4 is seen centrally and immediately beneath the upper support beam T3. These components are coupled to a set of SA 1 borne attachment components to complete the hookup of the tow vehicle to the SA 1.

The SA 1 borne attachment arrays for connecting said SA to a tractor include: the upper 3-point hitch attachment array Bracketed as 70 and a mirror image pair of lower 3-point hitch attachment arrays Bracketed as 80.

Note: throughout the remainder of this descriptive narrative, where any right and left assemblies are mirror images with the mirrored parts being assigned the same reference character, only one side of a pair will usually be indicated by said reference character.

The upper 3 point attachment array 70 comprises right and left mirror image assemblies, said assemblies, best viewed in FIG. 2 comprise a unitary whole formed by welding three pairs of functionally specific elements together, said functional elements being designated as follows for descriptive purposes: a pair of vertical Support plates 71 that are welded to below and extend upwards from the FTB 2 to their junction with; a pair of upwards extending Yoke plates 72 that are pierced by holes (not shown) designed to receive a bolt 74 that passes though said yoke-holes and though the hole in the swiveling-ball attachment end of the tractor borne upper three point hitch unit T1 (4) to complete the upper pole connection between the tractor and said SA; the final elements of the upper 3-point attachment arrays 70 are the paired and centrally placed upward and rearward projecting hydraulic ram front end connecting plates 73 which are pierced by holes (not shown) and spaced to receive and couple with the swiveling-ball attachment located on the fixed master hydraulic ram connector arm 22 located at the front end of the body section 21 of master hydraulic ram unit 20, said coupling being accomplished when bolt and nut assembly 74 is placed through the coupling holes of the above mentioned coupling elements.

The SA 1 borne mirror image pair of lower three point attachment sets 80 each comprise two vertically oriented parallel plates 81, 82 that are welded to and project forward from the front aspect of FTB 2, said parallel plates are spaced to receive and pierced with holes 84 (2) designed to receive the swiveling-ball attachment ends of the tractor borne lower three point hitch connecting arms T2 and T3 to which they are then connected by nut and bolt assemblies (not shown) and thus complete the lower pole connection between the tractor (not shown) and SA 1. Parallel plates 81, 82 optionally can be reinforced at their external plate surfaces by being welded to horizontal reinforcement struts 83 as needs may dictate, said reinforcement struts also being welded along their back surfaces to the front surface of the FTB 2.

The added versatility of the current invention that allows for controlled release of scraped up materials to the side of the SA 1 is brought into play by activating the master hydraulic ram unit 20 which is held in a fixed position at the front end of said SA by being bolted to the Hydraulic ram front end connecting plates 73 of said SA's upper 3-point attachment array 70; said hydraulic ram unit is activated from a tractor mounted control (not shown); which activation increases the fluid pressure in said hydraulic ram unit as hydraulic fluid is forced into it through a hydraulic fitting 26 to which fitting the hydraulic fluid has been delivered through a flexible hydraulic hose 36 (shown truncated for clarity); the increased pressure forces an extensible ram shaft 23 rearward out of the body of said hydraulic ram unit, where, by virtue of said extensible ram shaft's rear swiveling-ball attachment 24 being situated between the paired brackets 38 and held therebetween by nut and bolt assembly 28, and said brackets in turn being welded to the rear facing curved back plate 54 of the MBA 5, the rearward motion of said extensible ram shaft results in the free end of said MBA swinging back away from the basic box frame of said SA to which it had formerly been locked in place; the increased hydraulic pressure within said master hydraulic cylinder simultaneously leads to an outflow of hydraulic fluid from said master hydraulic ram unit through a hydraulic fitting 25 and thus into another hydraulic hose 37, which at its further end attaches to a hydraulic fitting 31 that leads into slave hydraulic ram unit (slave unit) 30, which slave unit is situated atop left side wall 4 to which it is attached at its forward end by virtue of its being affixed by bolt and nut assembly 34 into a vertical yoke assembly 33 that is welded below to the top plate section of said side wall with the resultant being. As hydraulic fluid moves into slave unit 30 the increasing pressure pulls an extensible ram shaft 32 forward into the body section of said slave unit, said extensible ram shaft terminates at its rearmost end as a yoke-fork 39 that is attached by a nut and bolt assembly 35 to the vertically situated lock arm section 41 and as said slave unit's extensible ram shaft is pulled forward it releases the lock assembly 40 that is best viewed in FIG. 7 and comprises: a vertically situated lock arm 41, which said lock arm is attached to the side wall 4 by nut and bolt set 43 around which it pivots as it swings forward at its top end along an arc indicated by line 41A thereby rotating the lock hook 42 up off the lock pin 44 along an arc indicated by line 42A with the range of travel of said arm being limited by Lock arm stop 48; the rotation of said lock hook off said lock pin frees the left end of the MBA 56 to be swung backwards along the arc indicated by line 56A; the pivoting forward of lock-arm 41 is accompanied by the stretching forward of a paired spring set 45 which said springs at their forward end have their terminal attachment coils situated around the bolt of bolt-nut set 35 and their rear attachment coils situated around the rear attachment rod 46 (7) that is in turn held firmly in place within the rear spring attachment post 47 that is welded to the top of the RTB 10. The length of the rearward arc of opening of the MBA 5 from it's associated side wall 4 is controlled by the operator of the pulling tractor, who, when the desired opening between said MBA and said side wall has been achieved, stops the process by discontinuing the increase of hydraulic pressure into the master ram unit 20 at which point the backward arc of movement of said MBA stops; and, simultaneously, the slave unit 30 sensing the decreased intensity of pressure, self-vents its fluid back towards said master unit, thereby discontinuing its traction of extensible ram shaft 32, following which the stretched spring set 45 returns to its relaxed length which in turn draws the lock arm 41 back into its original upright position and rotates the lock-hook 42 back down to its original position, but, with the lock-hook 42 no longer engaged around the lock pin 44 because the MBA 5 is still positioned rearward of the left side plate 4 of the SA 1.

Returning the MBA 5 to its closed position with said MBA's left end plate 57 approximating side wall 4, simply involves the tractor operator's reversing the action of the the tractor's hydraulic system such that a net pulling pressure is exerted on the hydraulic system with reversal of the directions of motion of all components of said system that were described immediately above. As MBA 5 continues its movement forward towards side wall 4, the sloped bottom section of lock hook 42, strikes lock pin 44 and vertical lock arm 41 move a short distance forward along arc 41A and spring set 45 becomes stretched forward, allowing said lock pin to move forward under said slightly elevated lock hook. As the MBA left end plate 56 comes back to its fully closed position relative to side wall 4, the continuing pull of spring set 45 returns vertical arm 41 to its original position and swivels lock hook 42 into it's locked position around lock pin 44, thus returning the SA 1 to the conventional form of a box scraper.

The total determination of the actual arc along which the MBA 5 moves when being opened away from the body of the SA 1 under the driving force imparted by the master hydraulic ram unit 20 involves the combined effects of several factors. As the MBA 5 is driven backwards the right end swivels back on the hinge 6 and the left end plate 56 of said MBA moves rearward relative to the SA's 1 left side plate 4, and the full weight of the MBA 5 as well as the additional forces imposed by the weight of the materials being scraped by said MBA are focused on the main frame components of SA1 nearest to hinge 6. The increased vertical and rotational forces imposed on the main frame is resisted by the combined actions of the following components which are best viewed in FIGS. 5 and 6; the MBA 5 opening guide plate 12 and the RTB 10 support assembly 13 (5). The mold board opening guide plate 12 is welded to the rear wall of the RTB 10 as well as being welded to the inferior border of the RTB 10's pyramidally shaped reinforcement support assembly 13. With the MBA 5 in the closed position, the bottom plate 14, top plate 15 and the end plate 16 of RTB support assembly 13 are seen to make up three sides of a closed pyramid, of which the third longitudinal wall (not visible) is made up of that portion of the rear plate wall of the RTB 10 to which said reinforcement support unit is welded, and the base of which pyramid is formed of the vertically situated bottom plate 16. With the MBA 5 in the closed position it will be noticed that the surfaces of the upper back section of the MBA 54 and the rear plate wall of the RTB 10 are planar in the vertical plane and the top plate 50 of said MBA is not visible.

Figure 5:
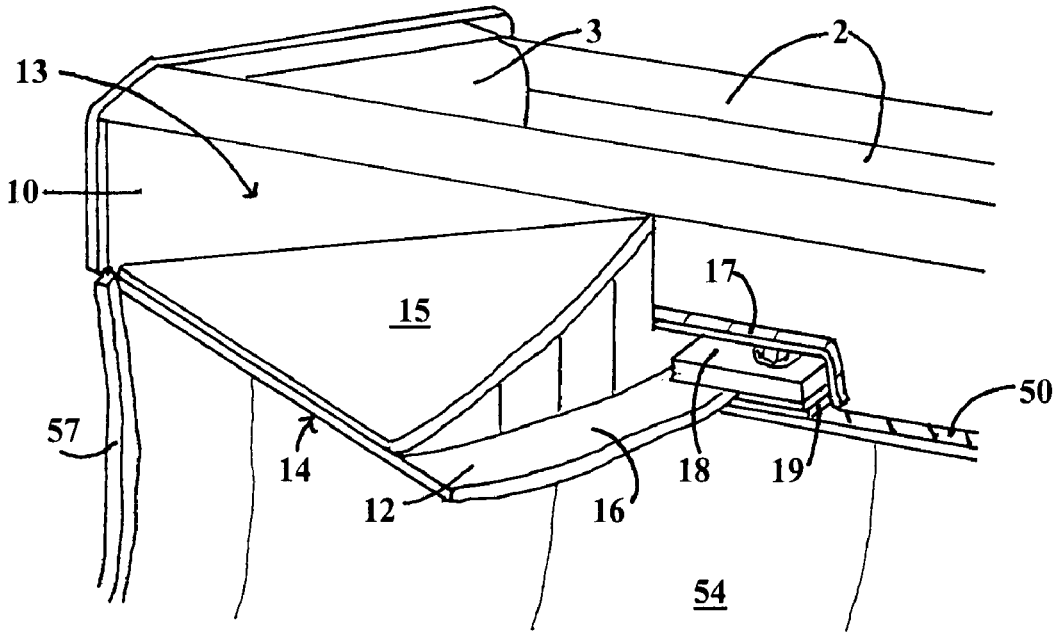
FIGS. 5 and 6 Present detail views showing the combination reinforcement-support/guidance-plate assembly of the non-movable upper section of the moldboard portion of the scraper in accordance with the invention, and not to scale.
Figure 6:
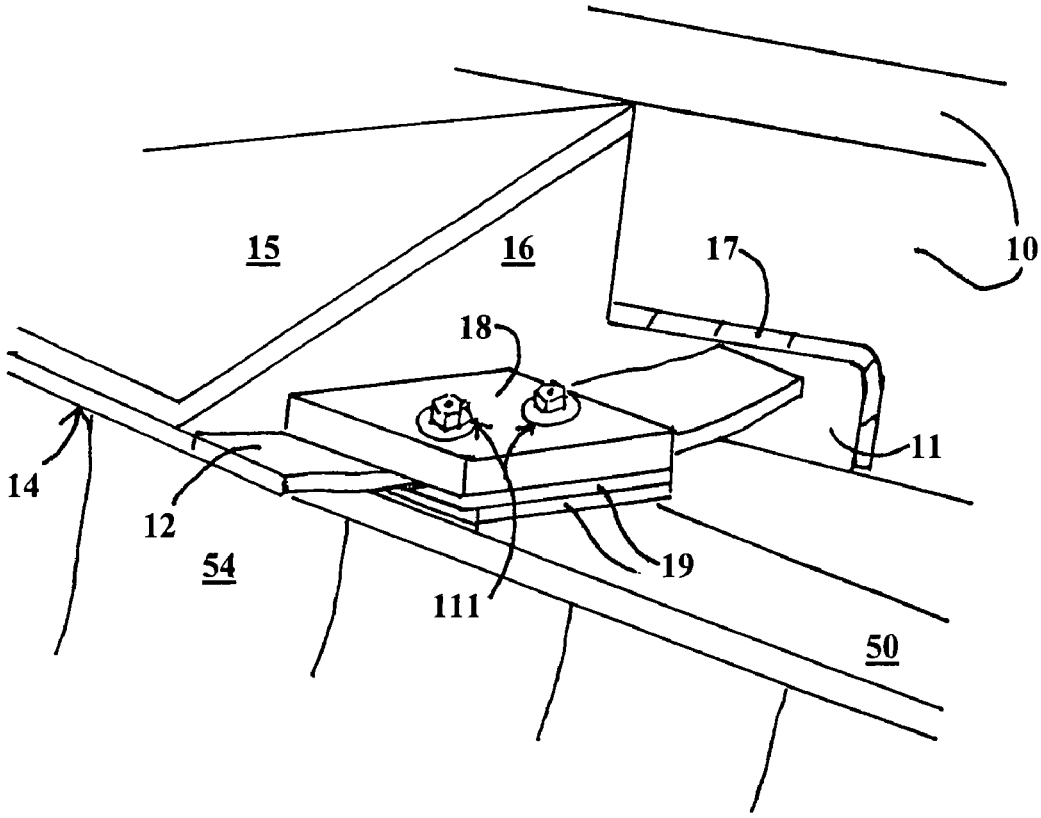

Looking now at FIG. 6, it is seen that MBA top plate 50 is visible, and the MBA borne guidance plate 18 that can be partially seen in FIG. 5 is now fully visible, said guidance plate being is elevated above said top-plate by two steel plate shims 19 that serve to provide adequate clearance between the bottom of said MBA 5 borne guidance plate and the top of the mold-board opening guide plate 12 to allow for horizontal movement between said opposed surfaces, and that said combined shims and MBA borne guidance plate are affixed to said MBA top plate by bolt and nuts 11. It is noted that the surfaces of the upper back section of the MBA 54 and the rear plate wall of the RTB 10 are no longer planar in the vertical plane, and that the MBA borne guidance plate 18 now rests well back on the RTB's mold-board opening guide plate 12 as compared to its position in FIG. 5 where it's contours are mostly obscured by reason of its resting within a cutout section 11 in the RTB 10's back wall, the upper margin of which cutout is demarcated by a narrow marginal reinforcing support plate 17.

What is claimed is:

1. A box scraper comprising a modified box having two parallel sides, a left side wall and a right side wall, an open top and an open bottom and a connecting element, a front top beam, said front top beam being affixed to said right and left side walls at the upper, inner aspects of said side walls, forming thus, at the topmost level, a partial closure of an otherwise open face situated between a front edge of each of said parallel sides, and open in a continuum with said open bottom of said box, a complete rear-wall comprising: a rear top beam, said rear top beam being affixed to said right and left side walls at the uppermost corners of said side walls, and a moldboard assembly, said moldboard assembly ending below in a cutting edge, said moldboard assembly having a lock-end and a hinge-end whereby said moldboard assembly is attached to one of said side walls by a hinge assembly connected to said hinge-end and said moldboard assembly being attached at said lock-end to the other of said side walls by a lock mechanism, and, by virtue of said hinge assembly and said lock mechanism, said moldboard assembly being made capable of swinging back from said side wall attached to said lock-end of said moldboard assembly, thus creating an opening between said side wall attached to said lock-end of said moldboard assembly and said moldboard assembly, operating means by which said lock mechanism can be opened or closed, second operating means by which said lock-end of said moldboard assembly can be selectively moved rearward from said side wall attached to said lock end of said moldboard assembly, or brought back into approximation with said side wall attached to said lock end of said moldboard assembly.

2. The scraper of claim 1 in which said rear top beam of said scraper has a reinforcement assembly, said reinforcement assembly comprising an assemblage designed to reinforce said rear top beam near said hinge-end of said moldboard assembly, said reinforcement assembly being welded to a rearward extending guidance plate that provides horizontal support along which a moldboard assembly borne support plate can move throughout the full arc of opening of said moldboard assembly.

3. The scraper of claim 1 in which said moldboard assembly ends below in both a forward and a rearward facing blade element.

4. An improved box scraper with means for attachment to a motive vehicle; said scraper comprising a modified box having two parallel sides, a full height left side wall and a full height right side wall, an open top and an open bottom and a full or partial height front opening, said front opening forming a continuum with said open bottom of said box; a sectional rear-wall, comprising an upper section integrally affixed to said right and left side walls at the uppermost comers of said side walls near their top rear terminations, and a moldboard assembly, said moldboard assembly ending below in at least one cutting edge; said moldboard assembly being pivotably connected to one of said side walls such that an opposite, non-pivotably connected end of said moldboard assembly can be allowed to move away from its normal apposition to said other of said side walls, allowing thus the formation of an opening that allows escape of previously collected materials from said box of said scraper laterally to the confines of said scraper; means for keeping said non-pivotably connected end of said moldboard assembly held in apposition to a homolateral wall of said scraper; second means for releasing said non-pivotably connected end of said moldboard assembly from its normal apposition to said homolateral wall of said scraper, and, controllably allow and direct a rearward movement of said non-pivotably connected end of said moldboard assembly away from said homolateral wall of said scraper in an arcuate pattern; said means for releasing said non-pivotably connected end of said moldboard assembly maintaining control such that said rearward movement can be controllably stopped and held steady at any point along the full range of said arcuate path of opening said moldboard assembly, and, the same said means for releasing said non-pivotably connected end of said moldboard assembly being able of controllably stopping and holding said moldboard assembly along a full range of a return path of said moldboard assembly towards apposition with said homolateral wall of said scraper.

5. The scraper of claim 4 in which said upper section of said sectional rear-wall of said scraper is integrally attached to a reinforcement assembly, said reinforcement assembly being situated close to the junction of said pivotably connected side wall and said moldboard assembly of said scraper; said reinforcement assembly comprising a horizontally aligned set of an upper triangular steel plate and a bottom triangular steel plate, said triangular steel plates welded to each other along one edge and having a second edge welded to a rear facing wall of said upper section of said sectional rear-wall, forming thus an elongated pyramid, an open bottom of said elongated pyramid is closed by being welded to a base plate covering an opening formed between said triangular plates and said rear facing wall of said upper section of said sectional rear-wall; said upper section of said sectional rear-wall also being integrally connected with a rearward extending guidance plate welded to extend rearward along the length of said bottom triangular steel plate of said reinforcement assembly; said guidance plate providing horizontal support along which a moldboard assembly borne support plate can move throughout a full arc of opening and closing of said moldboard assembly.

* * * * *